US006973780B2

(12) United States Patent
Hahn et al.

(10) Patent No.: US 6,973,780 B2
(45) Date of Patent: Dec. 13, 2005

(54) CONTROLLER FOR A HYDRAULIC PRESS AND METHOD FOR THE OPERATION THEREOF

(75) Inventors: Matthias Hahn, Saarburg (DE); Arno Möhn, Trier (DE)

(73) Assignee: Laeis GmbH, Trier (DE)

( * ) Notice: Subject to any disclaimer, the term of this patent is extended or adjusted under 35 U.S.C. 154(b) by 225 days.

(21) Appl. No.: 10/380,887

(22) PCT Filed: Aug. 24, 2001

(86) PCT No.: PCT/IB01/01527

§ 371 (c)(1),
(2), (4) Date: Apr. 15, 2003

(87) PCT Pub. No.: WO02/24441

PCT Pub. Date: Mar. 28, 2002

(65) Prior Publication Data

US 2003/0167936 A1 Sep. 11, 2003

(30) Foreign Application Priority Data

Sep. 20, 2000 (CH) ..... 1826/00

(51) Int. Cl.[7] ..... B30B 15/16; F15B 3/00
(52) U.S. Cl. ..... 60/413; 60/414
(58) Field of Search ..... 60/413, 414, 415, 60/416, 417, 418

(56) References Cited

U.S. PATENT DOCUMENTS 5,568,766 A * 10/1996 Otremba et al. ..... 60/413
5,852,933 A * 12/1998 Schmidt ..... 60/413
6,370,873 B1 * 4/2002 Schaich et al. ..... 60/413

FOREIGN PATENT DOCUMENTS

DE 4308344 A1 * 9/1994 ..... B30B/15/18
DE 4320213 A1 * 12/1994 ..... B21B/1/02
DE 4436666 A1 * 4/1996 ..... B30B/15/16
JP 63256300 A * 10/1988 ..... B30B/15/22

* cited by examiner

*Primary Examiner*—Thomas E. Lazo
(74) *Attorney, Agent, or Firm*—Cohen, Pontani, Lieberman & Pavane

(57) ABSTRACT

The invention relates to a controller for a hydraulic press, comprising a pressing cylinder (1), a reservoir (2), a valve group (3), a pressure medium reservoir (7) and a hydraulic pump (6), connected together by means of a cylinder line (4), a reservoir line (5) and a tank line (8). According to the invention, a pressure converter (9) is arranged on the valve group (3), which may operate as a pressure amplifier or pressure reducer. The particular mode of action of said controller is achieved whereby the valve group (3) comprises a pre-press valve (11), a low-pressure chamber outlet valve (12), a low-pressure chamber inlet valve (13), a main press valve (14), a closing valve (15), a pressure release valve (16) and a 3-way valve (17), which may be operated by a particular control sequence. Said invention is applicable in hydraulic presses and of particular advantage in presses for the forming of ceramic pieces such as tiles.

17 Claims, 7 Drawing Sheets

CONTROLLER FOR A HYDRAULIC PRESS AND METHOD FOR THE OPERATION THEREOF

PRIORITY CLAIM

This is a U.S. national stage application of application No. PCT/IB/01527, filed on Aug. 24, 2001. Priority is claimed to that application and to application No. 1826/00, filed Sep. 20, 2000 in Switzerland.

FIELD OF THE INVENTION

The present invention relates to a controller for a hydraulic apparatus, specifically to a controller for a hydraulic press machine and a method of operating same.

BACKGROUND OF THE INVENTION

Hydraulic presses are used when workpieces are to be formed or reformed. Hydraulic presses are also used for cutting operations. The required force of the hydraulic press depends on the workpiece. In the ceramic industry, presses having a pressing force of 20,000 kN or more are used. In this case, with a view to efficient manufacture, the cycle time for a pressing operation should be as short as possible. Cycle sequences of 20 strokes per minute are a guideline. The pressing force and the cycle time determine the energy to be expended, that is to say, in hydraulic presses, the power of pumps and of electric motors driving these pumps. In hydraulic presses according to the prior art, accumulators are also used, such as pressure medium accumulators or flywheels.

DE A1-43 20 213 discloses a hydraulic press that includes a feed circuit of the hydraulic pressing cylinder. A pressure medium accumulator is charged during the return stroke of the press and is utilized for the drive during the feed of the pressing die. Energy can thus be saved in the main drive.

JP-A-63 256 300 discloses a press which is operated with a multistage pressure converter. After a first pressing operation at low pressure, the hydraulic oil is discharged into the tank. A second pressing operation then takes place at high pressure. Energy recovery is consequently not possible in this case.

A hydraulic drive system for a press in the relevant field is disclosed in U.S. Pat. No. A-5,852,933 and DE A1-44 36 666. It contains a low-pressure and a high-pressure circuit. In this, there are three hydrostatic machines, two of which are coupled mechanically. In order to make satisfactory operation possible, these machines must be adjustable in terms of their absorption volume or delivery volume. This entails considerable costs. The system described here can be employed only when the press has differential cylinders or synchronous cylinders.

DE-A1-43 08 344 discloses the principle of secondary regulation for regulating the drive of a hydraulic press. The various movements of the press ram are combined with one another in such a way that the pressure network operates in a closed circuit, the maximum system pressure being determined by the pressure medium accumulator.

DE-A1-43 08 344 discloses that the hydraulic oil is definitely compressible also plays a part in the regulation of a hydraulic press. This has an effect in a press cycle during both compression and decompression and constitutes a source of losses.

The prior art has continued largely to ignore the fact that the mechanical parts of the press also absorb energy due to the elastic deformation of their components. This energy has to be expended during the closing operation of the press. This energy is not recovered during the opening operation.

SUMMARY OF THE INVENTION

It is an object of the present invention to provide a hydraulic press with the hydraulic control such that the total energy requirement is reduced without an associated increase in apparatus expenditures. Preferably, the control is in this case also to be capable of being used in a press with plunger cylinders.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drains are not necessarily drawn to scale and that, unless otherwise indicated, they are merely intended to conceptually illustrate the structures and procedures described herein.

PCT Publication Sheet, Int'l Preliminary Examination Report, Written Opinion, Int'l Search Report

DETAILED DESCRIPTION OF PRESENTLY PREFERRED EMBODIMENTS

Figure 1:
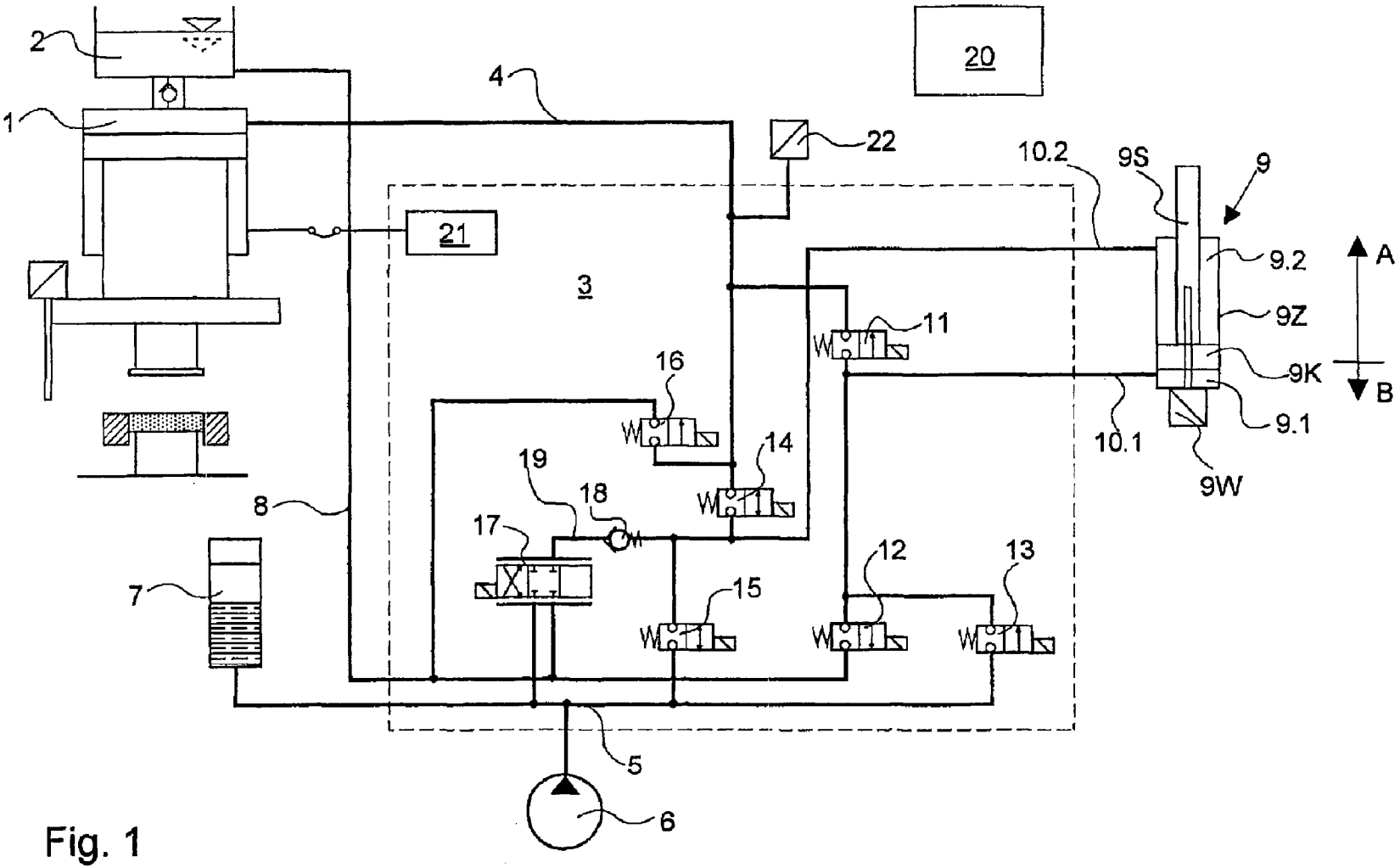
FIG. 1 is a schematic diagram of hydraulic system of a press control.

In FIG. 1, a press cylinder 1 is connected to a reservoir 2 for the hydraulic medium. A valve group 3 includes a series of valves.

The hydraulic medium is conveyed between the press cylinder 1 and the valve group 3 via a cylinder line 4.

An accumulator line 5 is connected to the valve group 3. A hydraulic pump 6 delivers hydraulic medium into this accumulator line 5 and is driven by an electric motor, which is not illustrated here. A pressure medium accumulator 7 is connected to the accumulator line 5 which also runs within the valve group 3. That is to say, also, the hydraulic pump 6 is capable of delivering the hydraulic medium into the pressure medium accumulator 7. A one-way valve, not illustrated, may be arranged in the line segment between the hydraulic pump 6 and the accumulator line 5, in order to relieve the hydraulic pump 6 of the pressure prevailing in the pressure medium accumulator 7, when the hydraulic pump 6 is not running.

A tank line 8 leads from the valve group 3 to the reservoir 2. Valve group 3 is connected to a pressure converter 9 which acts as a pressure intensifier and also as a pressure reducer. The pressure converter 9 has a piston 9K which is displaceable within a cylinder 9Z. Piston 9K separates a low-pressure space 9.1 having a large effective cross section from a high-pressure space 9.2 having a small effective cross section. In order to obtain the smaller effective cross section, a piston rod 9S connected to the piston 9K is located in the high-pressure space 9.2. The effective ratio in terms of pressure and volume flow is determined by the cross sections of the two pressure spaces 9.1 and 9.2. The cross sectional area is determined, for the low-pressure space 9.1, for the inside diameter of the cylinder 9Z according to $$A_{9.1}=\frac{1}{4}*d_{9Z}^{2}*\pi$$

and, for the high-pressure space 9.2, by the difference between the inside diameters of the cylinder 9Z and of the piston rod 9S according to $$A_{9.2}=\frac{1}{4}*(d_{9Z}-d_{9S})^{2}*\pi$$

$A_{9.1}$ is in this case the hydraulically effective cross sectional area of the low-pressure space 9.1, $A_{9.2}$ is that of the high-pressure space 9.2, $d_{9Z}$ is the inside diameter of the cylinder 9Z and $d_{9S}$ is the diameter of the piston rod 9S.

The pressure ratio of the pressure converter 9 and, correspondingly, also the ratio of the volume flows is therefore determined by $A_{9.1}:A_{9.2}$. The ratio $A_{9.1}:A_{9.2}$ is, for example, 2:1. The position of the piston 9K is detected by means of a displacement transducer 9W.

The low-pressure space 9.1 is connected to a pressure converter low-pressure line 10.1 of the valve group 3. Located on this pressure converter low-pressure line 10.1 are three switching valves: a prepressing valve 11, the second connection of which is connected to the cylinder line 4; a low-pressure chamber outlet valve 12, the second connection of which is connected to the reservoir 2 via the tank line 8; and a low-pressure chamber inlet valve 13, the second connection of which is connected to the accumulator line 5 and consequently also to the pressure medium accumulator 7.

The high-pressure space 9.2 is connected to a pressure converter high-pressure line 10.2 of the valve group 3. Valves are likewise located on this pressure converter high-pressure line 10.2: a main pressing valve 14, the second connection of which is connected to the cylinder line 4, and a stop valve 15, the second connection of which is connected to the accumulator line 5 and consequently also to the pressure medium accumulator 7.

A pressure relief valve 16 lies between the cylinder line 4 and the tank line 8. Moreover, a third valve, three-way valve 17, with a preceding one-way valve 18, is connected to the pressure converter high-pressure line 10.2. The three-way valve 17 is also connected to the accumulator line 5 and consequently also to the pressure medium accumulator 7 and, with its further connection, to the lank line 8 and therefore to the reservoir 2. The line segment 19 between the one-way valve 18 and the three-way valve 17 is a pressing line. The one-way valve 18 is, in functional terms, a back-flow stop valve. The functioning of the various valves 11, 12, 13, 14, 15, 16 and 17 is described in detail hereafter with reference to FIGS. 2 through 6. The valves can be activated electrically and are controlled by a control apparatus 20. For clarity, connecting lines from the control apparatus 20 to the valves 11, 12, 13, 14, 15, 16 and 17 are not shown in the figures.

The schematic diagram of the hydraulic system illustrates only the elements essential to the invention, there also being, in addition, a press safety lowering and pullback control 21 which is necessary for the reliable operation of the press cylinder 1 but is irrelevant in terms of the invention. A pressure transducer 22 which detects the pressure in the cylinder line 4 is also necessary.

The electric connections between the control apparatus 20, displacement transducer 9W, pressure transducer 22, press safety lowering and pullback control 21 and further safety-relevant elements on the press are also not shown for the sake of clarity.

Figure 2:
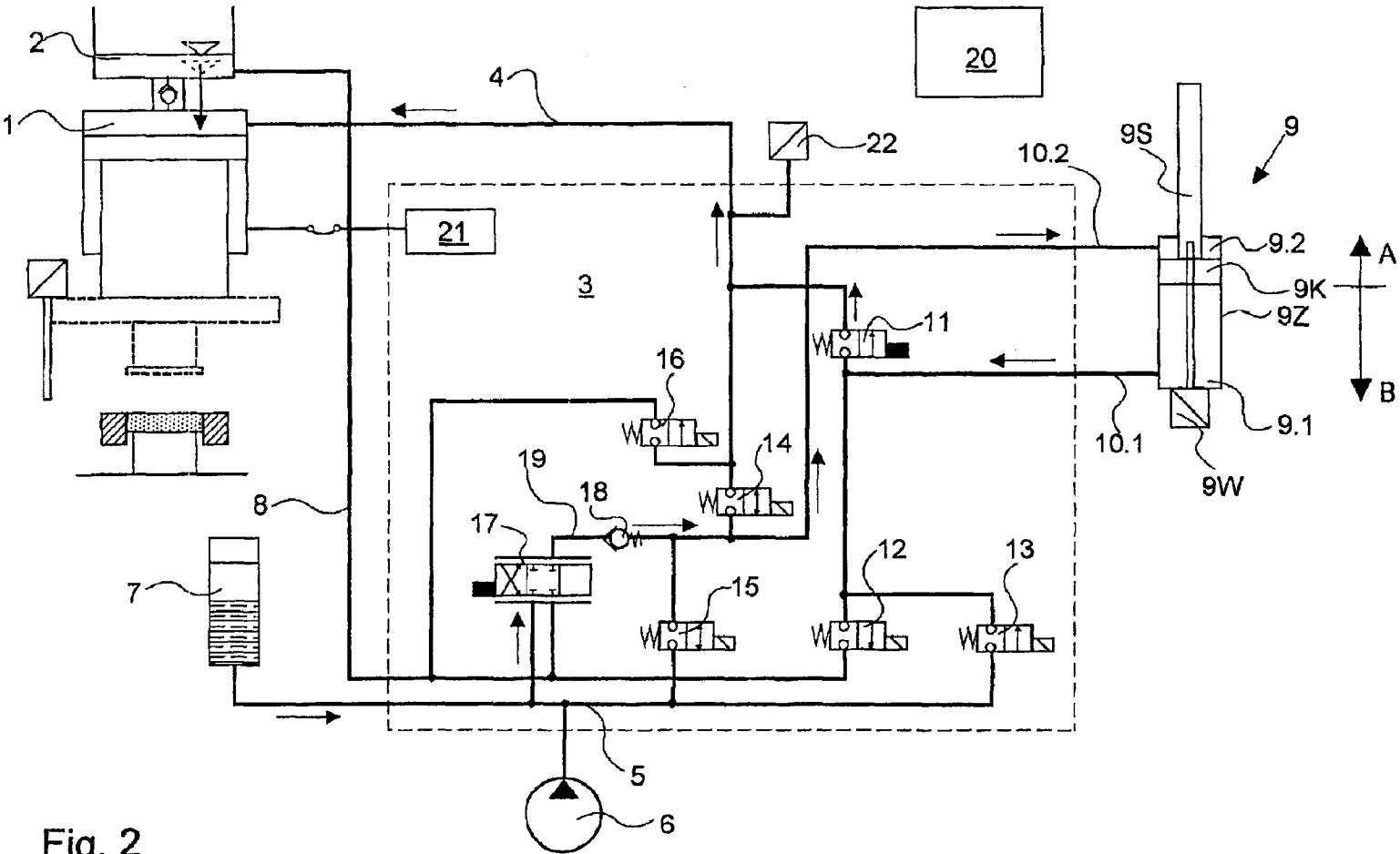
FIGS. 2 to 6 are illustrations of the hydraulic system showing individual steps within a cycle.

A first phase of the press operation, to be precise the buildup of the admission pressure, is described below with reference to FIG. 2. The press cylinder 1 is filled in the usual way with hydraulic medium from the reservoir 2, this being indicated by an arrow. As a result, the upper pressing die is lowered and consequently the mold is closed. The piston 9K is at the same time located in an upper position in the vicinity of its upper end position A.

The three-way valve 17 is then activated in such a way that it releases the throughflow from the connection of the accumulator line 5 to the connection of the pressing line 19. The activation of the three-way valve 17 using its electrically operated drive is marked in FIG. 2 in solid black. Opening of the three-way valve 17 permits hydraulic medium be flow from the pressure medium accumulator 7 via said three-way valve 17 via the pressing line 19, via the one-way valve 18 (which necessarily opens on account of the pressure of the hydraulic medium) and via the pressure converter high-pressure line 10.2 into the high-pressure space 9.2 of the pressure converter 9. This is indicated in FIG. 2 by the arrows.

At the same time, the prepressing valve 11 is also activated. The activation by its electrically operated drive is marked in solid black. Consequently, hydraulic medium can flow out of the low-pressure space 9.1 via the pressure converter low-pressure line 10.1 via the prepressing valve 11 and the cylinder line 4 into the press cylinder 1. Owing to the area ratio $A_{9.2}$ to $A_{9.1}$, the pressure converter 9 then acts as a pressure reducer, the quantity of hydraulic medium being increased according to the area ratio $A_{9.2}$ to $A_{9.1}$. When the area ratio $A_{9.2}$ to $A_{9.1}$, amounts, for example, to 1:2, the pressure is reduced in the ratio of 1:2 by means of the pressure converter 9, but the quantity of hydraulic medium is increased in the ratio of 1:2.

Due to the flow of the hydraulic medium, the piston 9K is moved in the direction of B.

It should also be noted that the three-way valve 17 is a proportionally controllable valve. That is, the drive of the three-way valve 17 is, for example, a proportional magnet, so that the pressure in the pressing line 9 and in the pressure converter high-pressure line 10.2 and therefore also the pressure in the pressure converter low-pressure line 10.1, in the cylinder line 4 and in the press cylinder 1 can be controlled or regulated.

When the desired admission pressure is reached, as detected by the pressure transducer 22, the detection transmitted from the latter to the control apparatus 20 and thus noted by the control apparatus 20, the control apparatus 20 causes the three-way valve 17 and the prepressing valve 11 to be closed.

Subsequently, then, the pressure relief valve 16 is activated and thus opened causing a loss of pressure in the press cylinder 1 and in the cylinder line 4. This is detected by the pressure transducer 22. Hydraulic medium consequently flows from the press cylinder 1 and the cylinder line 4 via the pressure relief valve 16 and through the tank line 8 to the reservoir 2. When the pressure transducer 22 determines that the press cylinder 1 and the cylinder line 4 are pressureless, the pressure relief valve 16 is closed again.

It may be advantageous to add a further phase in the buildup of an admission pressure. This is carried out in the way described above, but in this case with a higher admission pressure which is reached by means of an appropriately modified activation of the three-way valve 17. This phase may take place while the upper die, not shown, lies on the workpiece, likewise not shown. It may also be advantageous, however, to raise the upper die slightly.

After the phase for building up the admission pressure or admission pressures, the piston 9K is located, within the cylinder 9Z, near the lower end at B. This is detected by the displacement transducer 9W. This position is necessary so that the main pressing pressure required can subsequently be generated.

The next phase of press operation, the buildup of the main pressing pressure, then follows. This is described below with reference to FIGS. 3 and 4.

Figure 3:
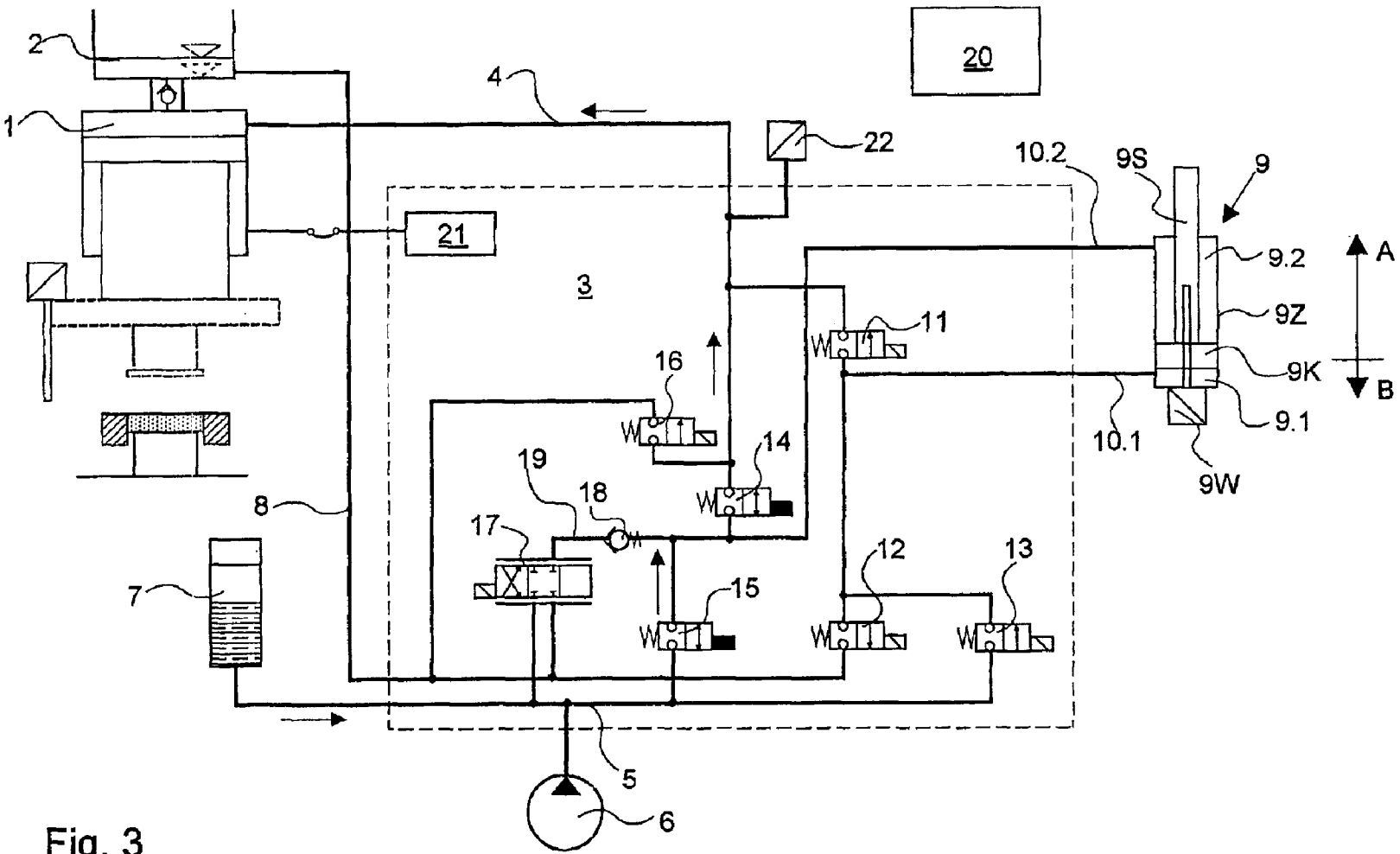

FIG. 3 shows the first step of this phase. This figure, then, again illustrates the activated valves by means of a solid black marking of the electric drives, and the flow of the hydraulic medium is indicated by arrows next to the lines.

As can be seen from FIG. 3, therefore, in this case the stop valve 15 and the main pressing valve 14 are activated. The stop valve 15 and the main pressing valve 14 are then opened. Valves 14, 15 are advantageously electrically activatable OPEN/SHUT valves. The prepressing valve 11, low-pressure chamber inlet valve 13, low-pressure chamber outlet valve 12 and pressure relief valve 16 are advantageously also electrically activatable OPEN/SHUT valves.

Activating stop valve 15 and main pressing valve 14 causes the flow of hydraulic medium from the pressure medium accumulator 7 via the accumulator line 5, through the stop valve 15 and the main pressing valve 14 and through the cylinder line 4 to the press cylinder 1. Thus, in the press cylinder 1, a pressure is built up which is predetermined, but corresponds at most to the pressure in the pressure medium accumulator 7.

Figure 4:
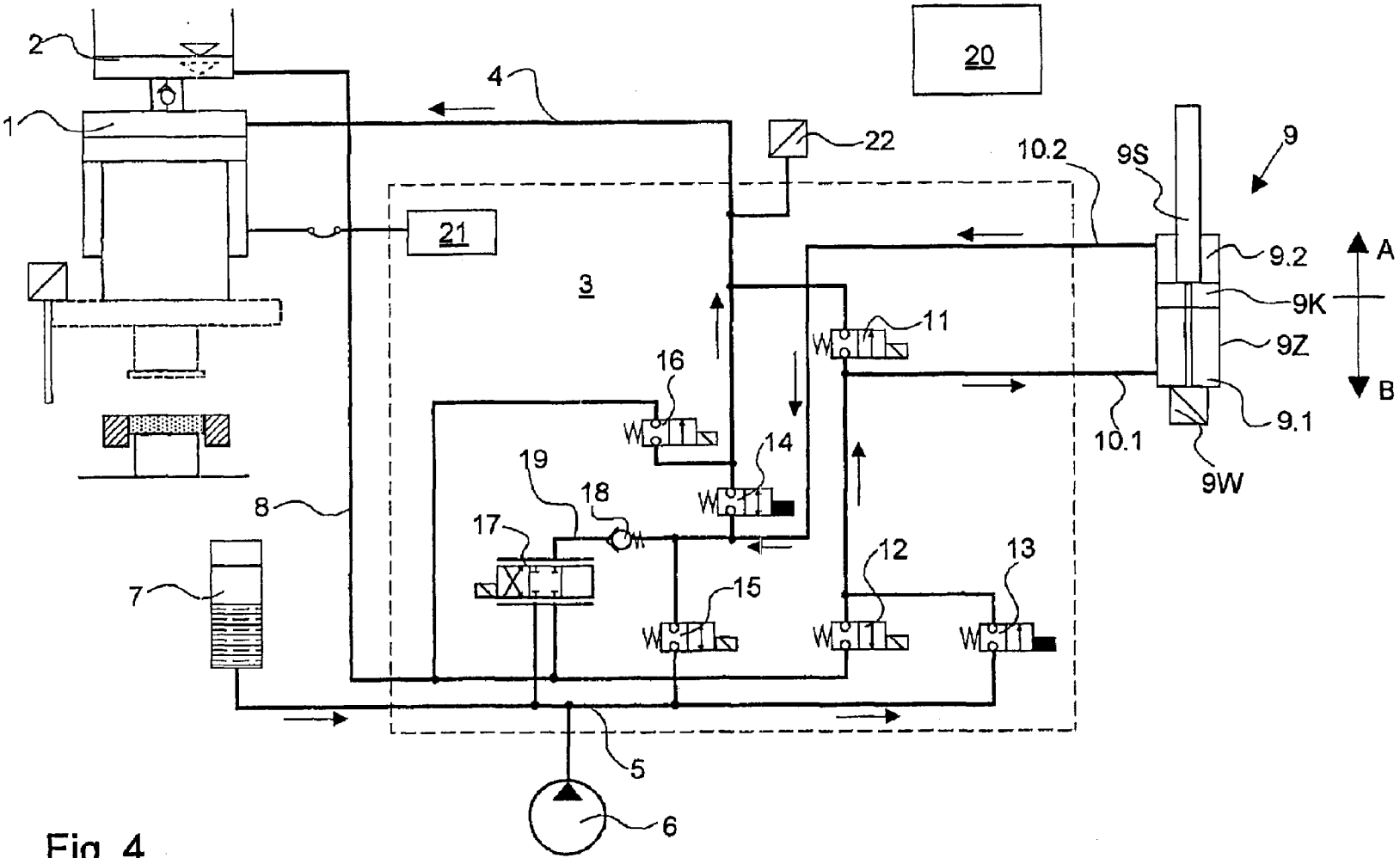

FIG. 4 shows the second step of the phase of building up the main pressing pressure. In this case, the low-pressure chamber inlet valve 13 and the main pressing valve 14 are activated by the electric drives of the valves 13, 14 that is to say open. This is indicated using solid black markings as in the previous figures. The flow of hydraulic medium which is established is again identified by arrows next to the lines.

Thus, the hydraulic medium then flows from the pressure medium accumulator 7 through the accumulator line 5 and the open low-pressure chamber inlet valve 13 and through the pressure converter low-pressure line 10.1 into the low-pressure space 9.1 of the pressure converter 9. The pressure prevailing in the pressure medium accumulator 7 also thereby arises in the low-pressure space 9.1. As a result of the area ratio $A_{9.2}$ to $A_{9.2}$, a higher pressure simultaneously arises in the high-pressure space 9.2, said pressure therefore being twice as high as the pressure in the pressure medium accumulator 7 in the case of an already mentioned area ratio $A_{9.2}$ to $A_{9.1}$ of 1:2. Since, however, the main pressing valve 14 is now also open, a likewise high pressure is built up in the press cylinder 1. At the conclusion of this phase of press operation, therefore, the pressure in the press cylinder 1 is twice as high as the pressure in the pressure medium accumulator 7 under the given conditions.

The buildup of this pressure in the press cylinder 1 is tracked by the pressure transducer 22. As soon as the desired pressure is reached, the low-pressure chamber inlet valve 13 and the main pressing valve 14 are closed again. It goes without saying that this pressure buildup is associated with a flow of hydraulic medium from the pressure medium accumulator 7 into the low-pressure space 9.1 and from the high-pressure space 9.2 via the cylinder line 4 to the press cylinder 1, with the result that the piston 9K is also displaced in the direction of A. Owing to the area ratio $A_{9.2}$ to $A_{9.1}$, the quantity of hydraulic medium flowing out from the high-pressure space 9.2 is in this case, under the given conditions of an area ratio $A_{9.2}$ to $A_{9.1}$ of 1:2, only half as large as the quantity of hydraulic medium which flows from the pressure medium accumulator 7 into the low-pressure space 9.1.

The press then reaches its maximum pressure and performs the pressing. Under the effect of this pressure, the stresses in the components of the press are also at the maximum values. Since the components are deformed elastically, energy is therefore stored in these components. A further energy potential is the compressible hydraulic medium volume in the press cylinder 1, press line 4, pressure converter high-pressure line 10.2 and high-pressure space 9.2 of the pressure converter 9.

A phase of relief with stress breakdown and decompression then subsequently takes place. This phase occurs in three steps, the first two of which are illustrated in FIGS. 5 and 6.

Figure 5:
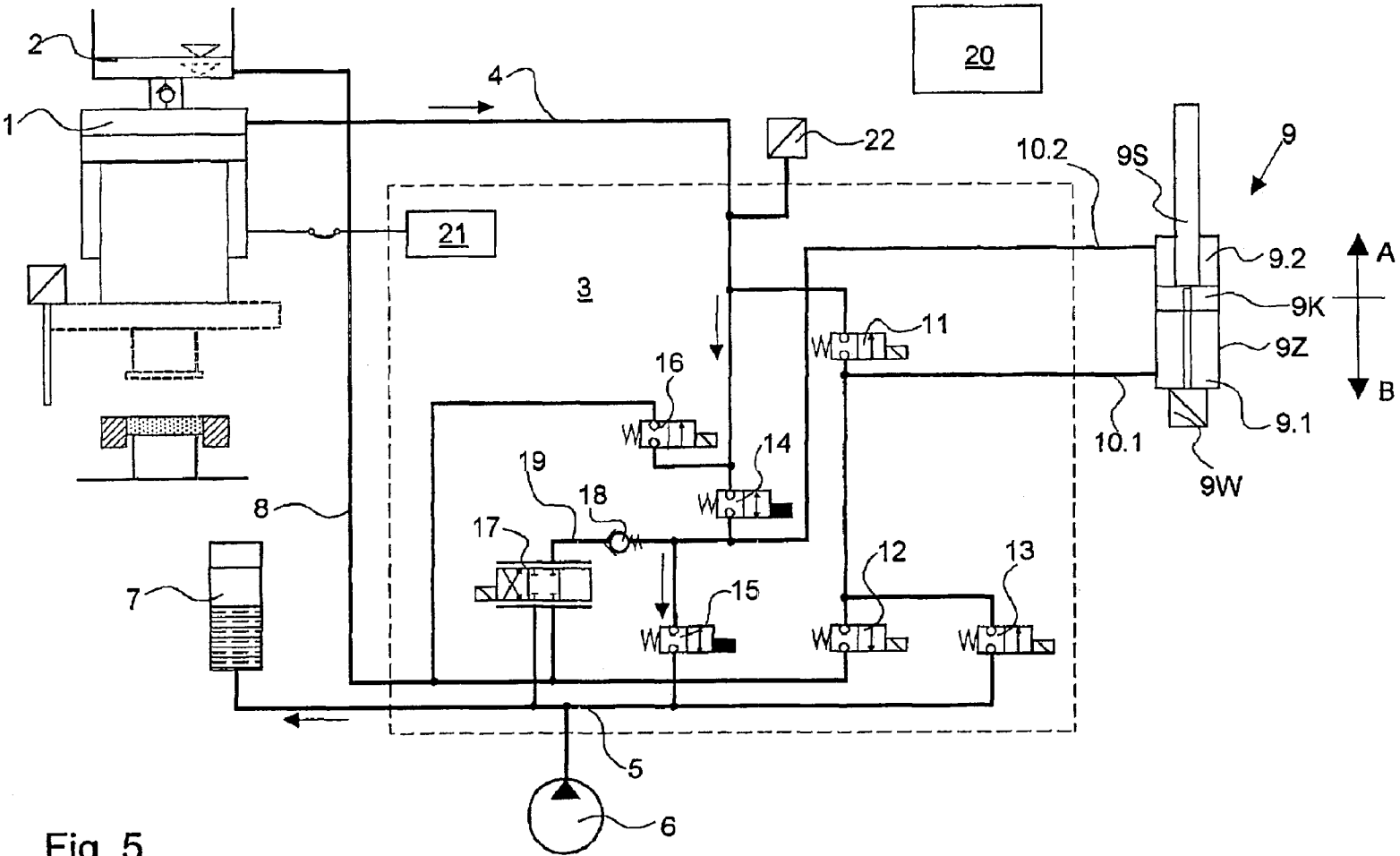
Figure 6:
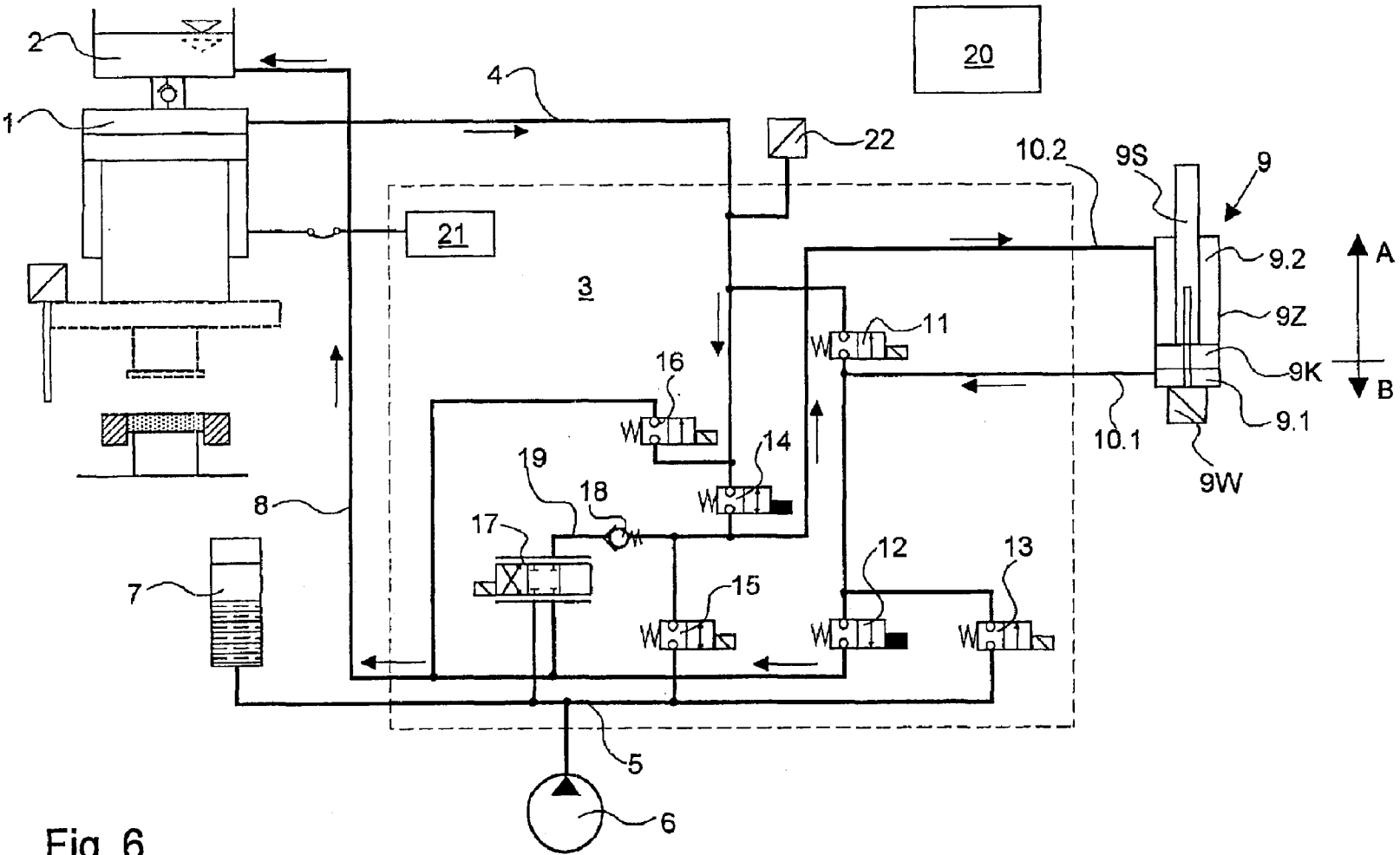

The first step is shown in FIG. 5. The main pressing valve 14 and the stop valve 15 are then open, this is illustrated by a solid black marking of the drives of the valves 14, 15 in a similar way to the previous figures.

The hydraulic medium can then flow from the press cylinder 1 to the pressure medium accumulator 7, at the same time following the path through the cylinder line 4, the main pressing valve 14, the stop valve 15 and accumulator line 5. The flow occurs because the pressure in the press cylinder 1 is higher than it is in the pressure medium accumulator 7. The first step lasts until the pressures in the press cylinder 1 and in the pressure medium accumulator 7 are equal. That is to say, however, also that a considerable part of the energy stored in the components of the press is recovered, in that the pressure in the pressure medium accumulator 7 is increased. This is an advantage of the controller according to the present invention and of the method for the operation thereof.

The second step of the relief phase is described with reference to FIG. 6, again the drives of the activated valves being illustrated as solid black markings, and the flow of hydraulic medium being is identified by arrows at the lines.

This second step serves for preparing the next press cycle. For this, the pressure converter 9 has to assume a predetermined position in the direction of B. The volume still remaining in the low-pressure space 9.1 of the pressure converter is then such that the admission pressures for the next work cycle can be provided by means of this volume. A check as to whether this is so can be made by means of the displacement transducer 9W. If this is not so, the residual pressure prevailing in the press cylinder 1, in the cylinder line 4 and in the pressure converter high-pressure line 10.2 is utilized, by the opening of the main pressing valve 14 and the low-pressure chamber outlet valve 12, in order to bring the piston 9K of the pressure converter 9 into the desired position.

This desired position is illustrated in FIG. 6. Therein, the high-pressure space 9.2 is also already filled again with pressurized hydraulic medium, so that no hydraulic medium at all has to be extracted from the pressure accumulator 7 for filling purposes. This signifies a further energy saving. The hydraulic medium displaced out of the low-pressure space 9.1 during the movement of the piston 9K passes via the low-pressure chamber outlet valve 12 through the tank line 8 into the reservoir 2. When the piston 9K has reached the desired position, this being determined by the displacement transducer 9W, the low-pressure chamber outlet valve 12 and the main pressing valve 14 are closed again.

Subsequently, in the third step, the residual pressure in the press cylinder 1 and in the cylinder line 4 is released by opening of the pressure relief valve 16. Thus, under the effect of the residual pressure, hydraulic medium flows from the press cylinder 1 through the cylinder line 4, the pressure relief valve 16 and the lank line 8 into the reservoir 2. The flow ceases as soon as the residual pressure in the press cylinder 1 is lost completely and the pressure will be equivalent to the ambient pressure. The pressure relief valve 16 is then closed again.

At the same time, however, the pressure in the high-pressure space 9.2 and in the pressure converter high-pressure line 10.2 is maintained. This pressure can be utilized during the next press cycle, thus resulting in an energy saving, since the pressure does not have to be built up anew.

Figure 7:
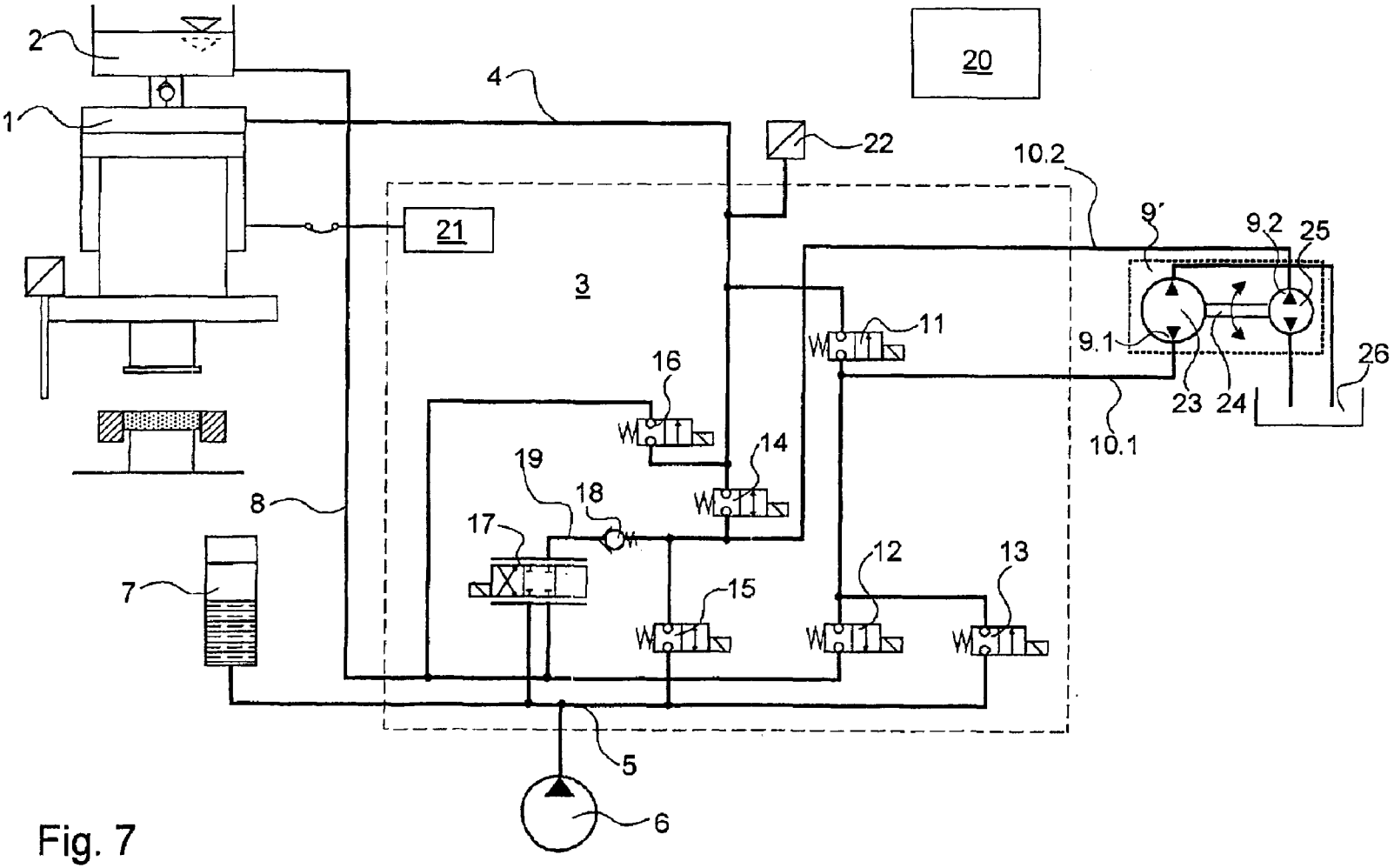
FIG. 7 shows a diagram of a design variant of the press control.

FIG. 7 shows an embodiment of the press control according to the present invention. Compared with the first embodiment of FIG. 1, the only change is that the pressure converter 9' is of a different type from the pressure converter 9 shown in FIGS. 1 to 6.

The pressure converter 9' includes a first pump 23 having a shaft 24 that is coupled rigidly to a second pump 25, so that the shaft 24 is common to both pumps 23, 25. The first pump 23 is connected to the pressure converter low-pressure line 10.1. That side of the pump 23 acts as a low-pressure space 9.1. Pump 23 is also connected to a tank 26. The second pump 25 is connected to the pressure converter high-pressure line 10.2 to act as a high-pressure space 9.2, and also is connected to likewise to the tank 26.

The two pumps 23, 25 are not driven by a motor, but, by virtue of the rigid connection, act in each case as a unit consisting of pump and of hydraulic motor, i.e. a single-stage pressure converter 9, as one skilled in the art would recognize. This combination of the two pumps 23, 25 takes effect as a pressure converter in that the specific delivery volume, that is to say the volume per revolution, is different. This is illustrated in FIG. 7 schematically by the different size of the pumps 23, 25. Thus, for example, this ratio amounts to 2:1. This also occurs in that the areas effective in the two pumps 23, 25 in the delivery of the hydraulic medium through the latter correspond to the areas $A_{9.1}$ and $A_{9.2}$ according to the first embodiment. Correspondingly, the pressure converter 9' behaves in exactly the same way as the pressure converter 9 during the different phases of press operation which are illustrated in FIG. 2 to 6 and described with reference to these figures. During the above-mentioned first phase of press operation, for example, the pressure converter 9' acts as a pressure reducer while the second pump 25 operates as a hydraulic motor and drives the first pump 23. In action as a pressure intensifier, the first pump 23 acts as a hydraulic motor which drives the second pump 25. The individual phases and their steps of a press cycle correspond to those of the first embodiment.

It is also advantageous, in this case, that a displacement transducer 9W is not required and the pressure converter 9' does not have to assume a predetermined position for the preparation of the next press cycle. This simplifies the control method.

Despite the seemingly simple construction of the controller according to the present invention, energy from individual pressing steps can be recovered by means of this controller. Thus, even the energy stored elastically in the press, in the workpiece and in the compressible hydraulic oil is recovered. At the same lime, the controller manages without costly structural elements, such as adjustable pumps.

It was found by means of tests that, by virtue of the controller according to the present invention, a considerable amount of energy savings can be achieved as compared with those known in the field of the art. The energy saving may definitely amount to around 40%.

The present invention may, in principle, be utilized to great advantage in hydraulic presses of various types for various fields of use. The press may in this case be equipped with differential cylinders, synchronous cylinders or else plunger cylinders. It is particularly advantageous if the controller according to the present invention is used in presses for the shaping of ceramic parts, such as tiles.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended thereto.

What is claimed is:

1. A controller for a hydraulic press, the hydraulic press including a press cylinder (1), a reservoir (2) for a pressure medium, a pressure medium accumulator (7), a hydraulic pump (6), operably connected to each other by a first plurality of connections, the first plurality of connections including a cylinder line (4) operably connecting the press cylinder (1), an accumulator line operably connected to the pressure medium accumulator, and a tank line;

the controller comprising:

a pressure converter (9,9') for altering a pressure of a pressure medium, the pressure converter (9,9') being a single-stage pressure converter, the converter comprising a cylinder (9Z), a piston rod (9S) for reducing a volume of the cylinder (9Z), a piston (9K) displaceable in the cylinder (9Z) for dividing the cylinder (9Z) into a low-pressure space (9.1) and a high-pressure space (9.2) separated from one another by the piston (9K) wherein the cross-sectional area ($A_{9.1}$) of the low-pressure space (9.1) is larger than the cross-sectional area ($A_{9.2}$) of the high-pressure space (9.2);

a control apparatus (20);

a valve group (3) operably connected to the press cylinder of the hydraulic press by the cylinder line of the first plurality of connections, the valve group (3) and the accumulator (7) being operably connected to one another by the accumulator line (5) of the first plurality of connections, and the valve group (3) being operably connected to the reservoir (2) by the tank line of the first plurality of connections;

a second plurality of connections for operably connecting the control apparatus (20) to the valve group (3); and a third plurality of connections for operably connecting the valve group (3) to the pressure converter (9,9'), wherein the valve group (3) further comprises a prepressing valve (11) operably connected to the cylinder line (4), a low-pressure chamber inlet valve (13) operably connected to the accumulator line (5), a low-pressure chamber outlet valve (12) operably connected to the tank line (8), a main pressing valve (14) operably connected to the cylinder line (4), a one-way valve (18), a three-way valve (17) operably connected to the one-way valve (18), to the accumulator line (5), and the tank line (8), and a stop valve (15) operably connected to the accumulator line (5); and wherein the third plurality of connections further comprises a pressure converter low-pressure line (10.1) for operably connecting the low-pressure space (9.1) to the prepressing valve (11), the low-pressure chamber inlet valve (13), and the low-pressure chamber outlet valve (12), and a pressure converter high-pressure line (10.2) for operably connecting the high-pressure space (9.2) to the main pressing valve (14), the stop valve (15), the one-way valve (18) and a pressing line (19) to the 3-way valve (17), the second connection of which lies on the accumulator line (5) and the third connection of which lies on the tank line (8).

2. The controller of claim 1, wherein the 3-way valve (17) is controllable proportionally.

3. The controller of claim 1, wherein the valve group (3) further comprises a pressure relief valve (16) operably connected the cylinder line (4) and the tank line (8).

4. The controller of claim 3, wherein the prepressing valve (11), the low-pressure chamber inlet valve (13), the low-pressure chamber outlet valve (12), the main pressing valve (14), the stop valve (15) and the pressure relief valve (16) are electrically controllable OPEN/SHUT valves.

5. A controller for a hydraulic press, the hydraulic press including a press cylinder (1), a reservoir (2) for a pressure medium, a pressure medium accumulator (7), a hydraulic pump (6), operably connected to each other by a first plurality of connections, the first plurality of connections including a cylinder line (4) operably connecting the press cylinder (1), an accumulator line operably connected to the pressure medium accumulator, and a tank line; the controller comprising:

a pressure converter (9,9') for altering a pressure of a pressure medium, the pressure converter (9,9') being a single-stage pressure converter, wherein the pressure converter (9') comprises:

a first pump (23) with a high specific delivery volume including a first side of the first pump (23) for acting as a low-pressure space (9.1), a second pump (25) with a low specific delivery volume including a first side of the second pump (25) for acting as a high-pressure space (9.2), and a shaft (24) for rigidly connecting a second side of the first pump to a second side of the second pump;

a control apparatus (20);

a valve group (3) operably connected to the press cylinder of the hydraulic press by the cylinder line of the first plurality of connections, the valve group (3) and the accumulator (7) being operably connected to one another by the accumulator line (5) of the first plurality of connections, and the valve group (3) being operably connected to the reservoir (2) by the tank line of the first plurality of connections;

a second plurality of connections for operably connecting the control apparatus (20) to the valve group (3); and a third plurality of connections for operably connecting the valve group (3) to the pressure converter (9,9'), wherein the valve group (3) further comprises a prepressing valve (11) operably connected to the cylinder line (4), a low-pressure chamber inlet valve (13) operably connected to the accumulator line (5), a low-pressure chamber outlet valve (12) operably connected to the tank line (8), a main pressing valve (14) operably connected to the cylinder line (4), a one-way valve (18), a three-way valve (17) operably connected to the one-way valve (18), to the accumulator line (5), and the tank line (8), and a stop valve (15) operably connected to the accumulator line (5); and wherein the third plurality of connections further comprises a pressure converter low-pressure line (10.1) for operably connecting the low-pressure space (9.1) to the prepressing valve (11), the low-pressure chamber inlet valve (13), and the low-pressure chamber outlet valve (12), and a pressure converter high-pressure line (10.2) for operably connecting the high-pressure space (9.2) to the main pressing valve (14), the stop valve (15), the one-way valve (18) and a pressing line (19) to the 3-way valve (17), the second connection of which lies on the accumulator line (5) and the third connection of which lies on the tank line (8).

6. The controller of claim 5, wherein the 3-way valve (17) is controllable proportionally.

7. The controller of claim 6, wherein the prepressing valve (11), the low-pressure chamber inlet valve (13), the low-pressure chamber outlet valve (12), the main pressing valve (14), the stop valve (15) and the pressure relief valve (16) are electrically controllable OPEN/SHUT valves.

8. The controller of claim 5, wherein the valve group (3) further comprises a pressure relief valve (16) operably connected the cylinder line (4) and the tank line (8).

9. A method of controlling a hydraulic press, the hydraulic press including a press cylinder (1), a reservoir (2) for a pressure medium, a pressure medium accumulator (7), a hydraulic pump (6), operably connected to each other by a first plurality of connections;

the controller including a pressure converter (9,9') for altering a pressure of a pressure medium; a control apparatus (20); a valve group (3) operably connected to the hydraulic press; a second plurality of connections for operably connecting the control apparatus (20) to the valve group (3); and a third plurality of connections for operably connecting the valve group (3) to the pressure converter (9,9'), wherein the valve group (3) comprises a prepressing valve (11) operably connected to the cylinder line (4), a low-pressure chamber inlet valve (13) operably connected to the accumulator line (5), a low-pressure chamber outlet valve (12) operably connected to the tank line (8), a main pressing valve (14) operably connected to the cylinder line (4), a one-way valve (18)

a three-way valve (17) operably connected to the one-way valve (18), to the accumulator line (5), and the tank line (8), and a stop valve (15) operably connected to the accumulator line (5), and wherein the third plurality of connections comprises a pressure converter low-pressure line (10.1) for operably connecting the low-pressure space (9.1) to the prepressing valve (11), the low-pressure chamber inlet valve (13), and the low-pressure chamber outlet valve (12), and a pressure converter high-pressure line (10.2) for operably connecting the high-pressure space (9.2) to the main pressing valve (14), the stop valve (15), the one-way valve (18) and a pressing line (19) to a 3-way valve (17), the second connection of which lies on the accumulator line (5) and the third connection of which lies on the tank line (8)

the method comprising the step of operating the pressure converter (9; 9') as a pressure intensifier or as a pressure reducer by (a) activating the three-way valve (17) and the prepressing valve (11) to force the pressure converter (9; 9') to act as a pressure reducer and to generate a first level of a pressure in the press cylinder (1);

(b) activating the stop valve (15) and the main pressing valve (14) to generate a predetermined second level of the pressure in the press cylinder (1), the second level of the pressure being less than or equal to a pressure in the pressure medium accumulator (7);

(c) activating the main pressing valve (14) and the low-pressure chamber inlet valve (13) to force the pressure converter (9; 9') to act as a pressure intensifier and to generate a third level of the pressure in the press cylinder (1), the third level of the pressure being greater than the pressure in the pressure medium accumulator (7);

(d) activating the main pressing valve (14) and of the stop valve (15) to reduce the pressure in the press cylinder (1) to a fourth level of the pressure, the fourth level substantially equal to the pressure in the pressure medium accumulator (7), and (e) activating the pressure relief valve (16) to reduce the pressure in the press cylinder (1) to the ambient pressure.

10. The method of claim 9 further comprising between step (d) and (e) the steps of:

determining if another press cycle is desired;

activating the main pressing valve (14) and the low-pressure chamber outlet valve (12) to bring the piston (9K) of the pressure converter (9) a predetermined position and repeating steps (a)–(d).

11. The method of claim 9 further comprising after step (a) the steps of:

activating the three-way valve (17) in a modified activation and activating the prepressing valve (11) to force the pressure converter (9; 9') to act as a pressure reducer and to generate an increase in the first level of the pressure in the press cylinder (1).

12. A method of controlling a hydraulic press for the shaping of ceramic parts, the hydraulic press including a press cylinder (1), a reservoir (2) for a pressure medium, a pressure medium accumulator (7), a hydraulic pump (6), operably connected to each other by a first plurality of connections;

the controller including a pressure converter (9,9') for altering a pressure of a pressure medium; a control apparatus (20); a valve group (3) operably connected to the hydraulic press; a second plurality of connections for operably connecting the control apparatus (20) to the valve group (3); and a third plurality of connections for operably connecting the valve group (3) to the pressure converter (9,9'), the valve group (3) comprising:

a prepressing valve (11) operably connected to the cylinder line (4), a low-pressure chamber inlet valve (13) operably connected to the accumulator line (5), a low-pressure chamber outlet valve (12) operably connected to the tank line (8), a main pressing valve (14) operably connected to the cylinder line (4), a one-way valve (18)

a three-way valve (17) operably connected to the one-way valve (18), to the accumulator line (5), and the tank line (8), and a stop valve (15) operably connected to the accumulator line (5); and wherein the third plurality of connections further comprises a pressure converter low-pressure line (10.1) for operably connecting the low-pressure space (9.1) to the prepressing valve (11), the low-pressure chamber inlet valve (13), and the low-pressure chamber outlet valve (12), and a pressure converter high-pressure line (10.2) for operably connecting the high-pressure space (9.2) to the main pressing valve (14), the stop valve (15), the one-way valve (18) and a pressing line (19) to a 3-way valve (17), the second connection of which lies on the accumulator line (5) and the third connection of which lies on the tank line (8);

the method comprising the step of operating the pressure converter (9; 9') as a pressure intensifier or as a pressure reducer by (a) activating the three-way valve (17) and the prepressing valve (11) to force the pressure converter (9; 9') to act as a pressure reducer and to generate a first level of a pressure in the press cylinder (1);

(b) activating the stop valve (15) and the main pressing valve (14) to generate a predetermined second level of the pressure in the press cylinder (1), the second level of the pressure being less than or equal to a pressure in the pressure medium accumulator (7);

(c) activating the main pressing valve (14) and the low-pressure chamber inlet valve (13) to force the pressure converter (9; 9') to act as a pressure intensifier and to generate a third level of the pressure in the press cylinder (1), the third level of the pressure being greater than the pressure in the pressure medium accumulator (7);

(d) activating the main pressing valve (14) and of the stop valve (15) to reduce the pressure in the press cylinder (1) to a fourth level of the pressure, the fourth level substantially equal to the pressure in the pressure medium accumulator (7), and (e) activating the pressure relief valve (16) to reduce the pressure in the press cylinder (1) to the ambient pressure.

13. A controller for a hydraulic press having a press cylinder, the controller comprising:

a reservoir connectable to the press cylinder and having a tank line;

a hydraulic pump feeding an accumulator line;

a pressure accumulator connected to the accumulator line;

a pressure converter having a high pressure space and a low pressure space provided with a high pressure line and a low-pressure line, respectively; and a valve group connecting the accumulator line, the high-pressure line, the low-pressure line, the cylinder and the tank line, the valve group comprising:

a prepressing valve having one side connected to the low pressure space by the low-pressure line and another side connected to the press cylinder by a cylinder line, a low pressure chamber inlet valve connected between the accumulator line and the one side of the prepressing valve, a low pressure chamber outlet valve connected between the tank line and the low-pressure line, a main pressing valve connected between the high pressure space and the cylinder line, the main pressing valve and the high pressure space being connected by the high pressure line, a stop valve connected between the accumulator line and the high pressure line, and a three-way valve connecting the accumulator line and the tank line to the high pressure space through a nonreturn valve and the high-pressure line.

14. The controller of claim 13, wherein the pressure converter comprises a shaft having opposite ends, a first pump coupled rigidly to one end of the shaft and configured to deliver a first specific volume, the first pump being connected to the low-pressure line and having one side, which bounds the low pressure space, a second pump coupled rigidly to the other end of the shaft and configured to deliver a second specific volume, the first specific volume being greater than the second specific volume, the second pump having one side connected to the high-pressure line, whereas the one side of the second pump bounds the high pressure space.

15. The controller of claim 13, wherein the pressure converter comprises a converter cylinder, a piston rod displaceable in the converter cylinder, a piston rigidly connected to the piston rod and displaceable therewith, the piston separating the low pressure space and the high pressure space, the low pressure space being greater than the high pressure space.

16. The controller of claim 13, wherein the valve group further comprises a pressure relief valve, the pressure relief valve having first and second sides connected to the cylinder line and to the tank line, respectively.

17. The controller of claim 16 further comprising a control apparatus operative to electrically control opening and closing of the low-pressure chamber inlet valve, the low-pressure chamber outlet valve, the main pressing valve, the stop valve, and the pressure relief valve.

* * * * *